United States Patent [19]

Yoshino

[11] Patent Number: 4,668,260

[45] Date of Patent: May 26, 1987

[54] HIGH-PURITY NITROGEN GAS PRODUCTION EQUIPMENT

[75] Inventor: Akira Yoshino, Osaka, Japan

[73] Assignee: Daidousanso Co., Ltd., Osaka, Japan

[21] Appl. No.: 845,278

[22] PCT Filed: Jul. 8, 1985

[86] PCT No.: PCT/JP85/00385

§ 371 Date: Mar. 12, 1986

§ 102(e) Date: Mar. 12, 1986

[87] PCT Pub. No.: WO86/00693

PCT Pub. Date: Jan. 30, 1986

[30] Foreign Application Priority Data

Jul. 13, 1984 [JP] Japan ..... 59-146331

[51] Int. Cl.[4] ..... F25J 3/00

[52] U.S. Cl. ..... 62/11; 62/33; 62/40; 62/42

[58] Field of Search ..... 62/9, 11, 32, 33, 34, 62/36, 40, 42

[56] References Cited

U.S. PATENT DOCUMENTS

| | | | |
|---|---|---|---|
| 2,940,269 | 6/1960 | Frainier | 62/11 |
| 3,062,016 | 11/1962 | Dennis et al. | 62/33 |
| 3,363,427 | 1/1968 | Blanchard et al. | 62/40 |
| 3,645,106 | 2/1972 | Gaumer, Jr. et al. | 62/9 |
| 4,526,425 | 7/1985 | McNiel | 62/39 |
| 4,526,595 | 7/1985 | McNiel | 62/39 |

*Primary Examiner*—Ronald C. Capossela

*Attorney, Agent, or Firm*—Armstrong, Nikaido, Marmelstein & Kubovcik

[57] ABSTRACT

There is disclosed high-purity nitrogen gas production equipment for production of ultra-high-purity nitrogen gas for use in the electronics and other industries, for example in connection with the production of silicon semiconductors. The conventional nitrogen gas production equipment of cryogenic air separation type tends to develop troubles and yields product nitrogen gas only at high cost and in comparatively low purity. The equipment according to the invention is such that a liquid nitrogen storage means (23) is connected via a first feeding pipeline (24*a*) to a distillation column (15) into which air is introduced from the outside via an air compression means (9) and heat exchange means (13), (14) while the above storage means (23) is also connected via a second feeding line (24*b*) to the above heat exchange means (13), (14). In this way, the raw material air is chilled to a cryogenic temperature as a result of absorption of the latent heat of evaporation by liquid nitrogen in the heat exchangers and the cryogenic compressed air is further chilled in the distillation column (15) by the heat of evaporation of liquid nitrogen. By taking advantage of the difference in boiling point, the nitrogen is withdrawn in gaseous state while oxygen is retained in liquid state. The resulting nitrogen gas is combined with the vaporized liquid nitrogen originating from the liquid nitrogen storage tank (23) to give product nitrogen gas. By these features, low-cost, high-purity nitrogen gas can be produced without machine troubles.

6 Claims, 14 Drawing Figures

HIGH-PURITY NITROGEN GAS PRODUCTION EQUIPMENT

TECHNICAL FIELD

The present invention relates to production equipment for high-purity nitrogen gas.

BACKGROUND ART

While the electronics industry consumes a very large quantity of nitrogen gas, stringent requirements have been imposed on the purity of the nitrogen gas they use from the standpoint of maintenance of the high precision of parts. Nitrogen gas is generally produced from air in a production sequence which consists of compressing the air with a compressor, passing the compressed air through an adsorbent column to remove carbon dioxide gas and water, feeding the emerging air further to a heat exchanger where it is chilled by heat exchange with a refrigerant, feeding the chilled air to a distillation column for cryogenic liquefaction and separation to give product nitrogen gas, and finally passing the same through said heat exchanger to heat it up to a temperature near atmospheric temperature. However, the product nitrogen gas thus produced contains oxygen as an impurity and the use of this nitrogen gas as it is presents various problems. One of the methods for removing impurity oxygen (1) comprises adding a small amount of hydrogen to nitrogen gas and reacting the hydrogen in the mixture with the impurity oxygen in the nitrogen gas in the presence of a platinum catalyst at a temperature of about 200° C. to remove the impurity oxygen in the form of water. Another method (2) comprises contacting nitrogen gas with a nickel catalyst at a temperature of about 200° C. to remove the impurity oxygen by way of the reaction $Ni + \frac{1}{2}O_2 + NiO$. However, as both methods involve the step of heating nitrogen gas to a high temperature for catalytic reaction, the corresponding hardware cannot be built into the nitrogen gas production line which is a cryogenic system. That is to say, the purification equipment must be installed independently of the nitrogen gas production equipment and this entails, of necessity, the disadvantage that the overall size of the production plant is increased. Furthermore, the first-mentioned method (1) requires exact control over the addition level of hydrogen. Unless hydrogen is added in an amount exactly commensurate with the amount of impurity oxygen present, either some oxygen remains in the product gas or the very hydrogen so added becomes a new impurity, so that high skill is required in operation. In the second-mentioned method (2), the NiO produced in the reaction with impurity oxygen must be regenerated ($NiO + H_2 \rightarrow Ni + H_2O$) and the cost of the $H_2$ gas equipment for catalyst regeneration contributes to an increased purification cost. Solutions to these problems have been awaited.

Furthermore, the conventional nitrogen gas production equipment employs an expansion turbine for chilling the refrigerant used for heat exchange with compressed air from the compressor and this turbine is driven by the pressure of the gas generated by gasification of the liquid air collecting in the distillation column, as a result of cryogenic liquefaction and separation, the low-boiling nitrogen leaves the column, while the balance in the form of an oxygen-rich liquid air collects in the column). However, the expansion turbine has a high rotational speed (in the order of tens of thousand revolutions per minute) and cannot easily follow a variation in load, thus requiring a specially trained operator. Moreover, as a high-speed machine, the expansion turbine not only demands high-precision in construction and is costly but requires specially trained personnel for its operation. These problems emanate all from the high-speed rotary mechanism of the expansion turbine and there has been a strong demand for elimination of the expansion turbine having such a high-speed rotary mechanism. Furthermore, an equipment capable of producing oxygen gas as well as nitrogen gas with the expansion turbine eliminated, if such becomes available, will be convenient since one single equipment can produce nitrogen gas and oxygen gas.

OBJECT OF THE INVENTION

It is a primary object of the present invention to provide a high-purity nitrogen gas production equipment which requires neither an expansion turbine nor a purification system. A further object is to provide a high-purity nitrogen gas production equipment which can also produce oxygen gas simultaneously.

DISCLOSURE OF THE INVENTION

Developed for the purpose of accomplishing the above-mentioned object, the present invention provides a high-purity nitrogen gas production equipment which comprises, in one aspect, an air compression means for compressing the air from an external environment, an elimination means for eliminating carbon dioxide gas and water from the compressed air, a heat exchange means for chilling the compressed air from said elimination means to a cryogenic temperature, a nitrogen distillation column adapted to liquefy a portion of the cryogenic compressed air from said heat exchange means and collect the same therein while retaining nitrogen alone in gaseous form, a liquid nitrogen storage means for storing liquid nitrogen, a first feeding pipeline for leading liquid nitrogen in said liquid nitrogen storage means to said nitrogen distillation column for use as a refrigerant, a second feeding pipeline for leading liquid nitrogen in said liquid nitrogen storage means to said heat exchange means for use as a refrigerant for said heat exchange means and a nitrogen gas withdrawal line for withdrawing the retained gaseous nitrogen from said nitrogen distillation column as product nitrogen gas. In accordance with a second aspect of the invention, said equipment further comprises a means for improving the purity of product nitrogen gas as provided in the nitrogen gas withdrawal line for withdrawing the product nitrogen gas from said nitrogen distillation column, said means being an adsorption means containing an adsorbent capable of selectively adsorbing oxygen and carbon monoxide at cryogenic temperatures. In accordance with a third aspect of the invention, said equipment additionally comprises an oxygen distillation column disposed separately from said nitrogen distillation column, whereby oxygen gas can also be produced besides nitrogen by feeding oxygen-rich liquid air remaining after separation of nitrogen gas from said nitrogen distillation column to said oxygen distillation column. In accordance with a fourth aspect of the invention, said equipment avoids the use of such oxygen distillation column according to said third aspect but employs an adsorption tube or column containing an adsorbent capable of selectively adsorbing nitrogen as disposed in a discharge line extending from said nitrogen distillation column [for discharging oxygen-rich liquid air (or vapor thereof) after separation of nitrogen gas into the exterior] to thereby remove nitrogen fraction from the oxygen-rich liquid air passing said discharge line so as to convert the latter to oxygen gas, said equipment thus producing oxygen gas in addition to nitrogen gas obtained from said nitrogen distillation column.

EFFECTS OF THE INVENTION

The high-purity nitrogen gas production equipment according to the present invention does not employ an expansion turbine but, instead, employs a liquid nitrogen storage means such as a liquid nitrogen storage tank having no rotary element and, therefore, the whole equipment has no revolving parts and, hence, is trouble-free. Furthermore, whereas the expansion turbine is costly, the liquid nitrogen tank is not expensive and does not require special personnel for operation. In addition, the expansion turbine (which is driven by the pressure of the gas generated from the liquefied air collected within the nitrogen distillation column) is driven at a very high speed (the order of tens of thousand revolutions per minute), it is difficult to follow a delicate variation in load (the variation in the rate of withdrawal of product nitrogen gas). Therefore, it is difficult to accurately vary the supply of liquefied air to the expansion turbine according to the change in the outgoing product nitrogen gas so as to chill the compressed air, which is the raw material for nitrogen gas, to a constant temperature at all times. As a consequence, the product nitrogen gas varies in purity so that low-purity products may be withdrawn from time to time to affect the overall quality of production.

In contrast, as the equipment according to the present invention employs a liquid nitrogen storage tank, in lieu of the expansion turbine, and liquid nitrogen, which permits delicate control of feed, as a refrigerant for both the heat exchange means such as a heat exchanger and the nitrogen distillation column, the equipment allows for delicate follow-up of load variation and, thus, enables one to produce nitrogen gas of extremely high and uniform purity. This, in turn, enables one to dispense with the purification system heretofore required. Furthermore, said equipment does not waste resources since liquid nitrogen is used as a refrigerant and, after use, made up into product nitrogen gas together with nitrogen gas produced by using air as the raw material, without allowing escape thereof. The equipment according to the second aspect of the invention, which has, in the product nitrogen gas withdrawal line of the equipment according to the first aspect of the invention, an adsorption means containing an adsorbent capable of selectively adsorbing oxygen and carbon monoxide at cryogenic temperatures, produces further improvement in the purity of product nitrogen gas as a result of adsorptive removal of impurity oxygen and so on contained therin. In the equipment according to the third aspect of the invention, an oxygen distillation column is used additionally in the equipment according to the above first aspect to thereby produce oxygen gas by feeding oxygen-rich liquid air after separation of nitrogen gas from the nitrogen distillation column to the oxygen distillation column, so that oxygen gas can be produced efficiently. In this way, this equipment by itself can produce high-purity nitrogen gas and oxygen gas efficiently and thus is best suited for use in the electronics industry. Furthermore, in the equipment according to the fourth aspect of the invention, in which an adsorption tube or column containing an adsorbent capable of adsorbing nitrogen selectively is disposed in the discharge line extending from the nitrogen distillation column [for discharging oxygen-rich liquid air (or vapor thereof) after separation of nitrogen gas into the exterior] thereby removing nitrogen portion from the oxygen-rich liquid air flowing in said discharge line so as to give oxygen gas to be withdrawn as product oxygen gas, so that said equipment can readily produce oxygen gas with relatively high purity although the purity of oxygen gas is somewhat inferior as compared with the equipment according to the third aspect mentioned above. In this way, also the equipment according to the fourth aspect can produce both of high-purity nitrogen gas and oxygen gas having relatively high purity.

BEST MODE FOR CARRYING OUT THE INVENTION

The present invention will be described in detail with reference to its embodiments.

Figure 1:
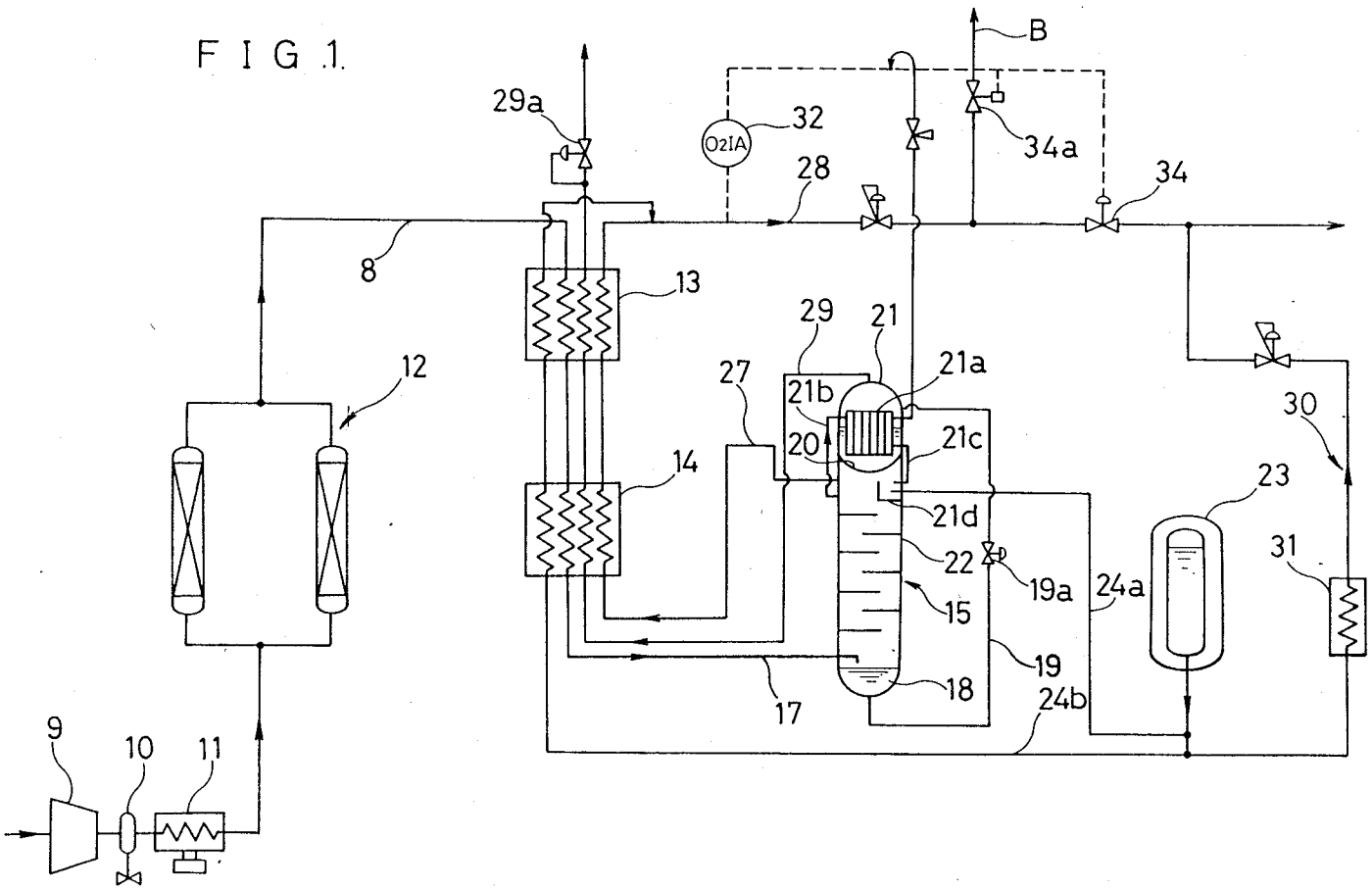
FIG. 1 is a schematic process diagram showing one embodiment of the present invention.

FIG. 1 shows an embodiment of the present invention. In FIG. 1, the reference numeral 9 indicates an air compressor, 10 a drain separator, 11 a freon refrigerator, and 12 a couple of adsorbent columns. Each adsorbent column 12 is packed with a molecular sieve which adsorbs and removes $H_2O$ and $CO_2$ from the compressed air from said air compressor 9. Indicated at 8 is a compressed air pipeline for feeding the compressed air freed of $H_2O$ and $CO_2$ by adsorption. The numeral 13 indicates a first heat exchanger which is supplied with the compressed air freed of $H_2O$ and $CO_2$ in the adsorbent column couple 12. To a second heat exchanger 14 is fed the compressed air from the first heat exchanger 13. The numeral 15 indicates a nitrogen distillation column, the top portion of which constitutes a partial condenser segment 21 having a condenser 21*a*, with the underneath portion constituting a column segment 22. In the distillation column, the compressed air chilled to a cryogenic temperature in the first and second heat exchangers 13, 14 and fed via the pipeline 17 is further chilled and a portion thereof is liquefied and collects in the bottom of the column segment 22 as liquefied air 18 while nitrogen alone is pooled in gaseous state in the top ceiling portion of the column segment 22. A liquid nitrogen storage tank 23 contains liquid nitrogen (high-purity product) which is fed partly via a first feeding pipeline 24a into the top of the column segment 22 of the distillation column 15 for use as a refrigerant for the compressed air introduced into the column segment 22 and partly via a second feeding pipeline 24b into the first and second heat exchangers 14, 13 for heat exchange with the compressed air introduced into the heat exchangers 14, 13 to chill said air to a cryogenic temperature. In this case, the liquid nitrogen itself evaporates as a result of heat exchange in the heat exchangers 14, 13 and fed into a main pipeline 28 in the form of ordinary-temperature gas. The above-mentioned distillation column 15 is now described in detail. The distillation column 15 is divided by a partitioning plate 20 into the partial condenser segment 21 and the column segment 22, and the condenser 21a in the partial condenser segment 21 is supplied with a portion of the nitrogen gas collected in the top portion of the column segment 22 via a pipeline 21b. The inside of this partial condenser segment 21 is relatively decompressed with respect to the inside of the column segment 22, and the liquefied air 18 ($N_2$, 50–70%; $O_2$, 30–50%) pooled in the bottom of the column segment 22 is fed via a pipeline 19 equipped with an expansion valve 19a and gasified therein to lower the internal temperature to a level below the boiling point of liquid nitrogen. As a result of this chilling, the nitrogen gas fed into the condenser 21a is liquefied. The top portion of the column segment 22 of the distillation column 15 is supplied with the liquid nitrogen produced in the condenser 21a of said partial condenser segment 21 via a down-coming pipeline 21c and also with liquid nitrogen from the liquid nitrogen storage tank 23 via the pipeline 24a. These two streams of liquid nitrogen flow down the column segment 22 from a liquid nitrogen basin 21d and come in countercurrent contact with, and cool, the compressed air ascending from the bottom of the column segment 22 to thereby liquefy part of the compressed air. In this process, the high-boiling components in the compressed air are liquefied and collect in the bottom of the column segment 22, while nitrogen gas which is a low-boiling component collects in the top portion of the column segment 22. The reference numeral 27 indicates a withdrawal pipeline for withdrawing the nitrogen gas cooled in the top ceiling portion of the column segment 22 of the distillation column as product nitrogen gas. This pipeline guides the cryogenic nitrogen gas to the second and first exchangers 14, 13 for heat exchange with the compressed air fed thereto, and leads it at atmospheric temperature to a main pipeline 28. In this connection, since low-boiling He (−269° C.) and $H_2$ (−253° C.) tend to collect, together with nitrogen gas, in the uppermost portion of the column segment 22 of the distillation column, the withdrawal pipeline 27 is disposed to communicate at a substantial distance below the uppermost portion of the column segment 22 so that pure nitrogen gas free from He and $H_2$ may be withdrawn as product nitrogen gas. The reference numeral 29 indicates a pipeline for feeding gasified liquid air in the partial condenser segment 21 to the second and first heat exchangers 14, 13, with a pressure control valve thereof being indicated at 29a. The numeral 30 indicates a backup system line which, in the event of a failure of the air compression line, evaporates the liquid nitrogen in the liquid nitrogen storage tank 23 by means of an evaporator 31 and feeds it to the main pipeline 28 so as to prevent interruption of nitrogen gas supply. Indicated at 32 is an impurity analyzer which analyzes the purity of product nitrogen gas going out into the main pipeline 28 and, when the purity is low, actuates valves 34 and 34a to let off the product nitrogen gas in the direction indicated by the arrow-mark B.

The equipment described above produces product nitrogen gas in the following manner. Thus, the air compressor 9 compresses the material air and the drain separator 10 removes water from the compressed air. The freon refrigerator 11 chills the compressed air and the chilled air is fed to the adsorption columns 12, where $H_2O$ and $CO_2$ in the air are adsorbed and removed. This compressed air freed of $H_2O$ and $CO_2$ is fed to the first and second heat exchangers 13, 14 which have been cooled by the liquid nitrogen supplied from the liquid nitrogen storage tank 23 via the second feeding pipeline 24b and the product nitrogen gas supplied from the distillation column 15 via the pipeline 27, etc., where it is chilled to a cryogenic temperature. The chilled air is then directly charged into a lower portion of the column segment 22 of the distillation column. This charged compressed air is chilled by contact with the liquid nitrogen fed into the column segment 22 from the liquid nitrogen storage tank 23 and the liquid nitrogen overflowing the liquid nitrogen basin 21d, whereby a portion of the air is liquefied and collects as liquid air 18 in the bottom of the column segment 22. In this process, due to the difference between nitrogen and oxygen in boiling point (boiling point of oxygen −183° C.; boiling point of nitrogen −196° C.), oxygen which is a high-boiling fraction in the compressed air is liquefied while nitrogen remains as a gas. Then, this remaining gaseous nitrogen is withdrawn through the withdrawal pipeline 27 and fed to the second and first heat exchangers 14, 13, where it is heated to a temperature near atmospheric temperature. This nitrogen is withdrawn from the main pipe 28 as product nitrogen gas. In this process, that portion of liquid nitrogen as fed to the column segment 22 from the liquid nitrogen storage tank 23 via the first feeding pipeline 24a serves as a refrigerant for liquefying the compressed air and the nitrogen itself vaporizes and is withdrawn as a part of product nitrogen gas via the withdrawal pipeline 27. The liquid nitrogen fed to the second and first heat exchangers 14, 13 from the liquid nitrogen storage tank 23 via the second feeding pipeline 24b serves as a refrigerant for cooling the heat exchangers and said nitrogen itself vaporizes and is sent into the main pipeline 28 so as to constitute a part of product nitrogen gas. In this way, the liquid nitrogen from the liquid nitrogen storage tank 23 is not discarded after use thereof as a refrigerant for the heat exchangers 14, 13 but is combined with the high-purity nitrogen gas produced from the raw material compressed air to give a product, so that it is used economically.

Figure 2:
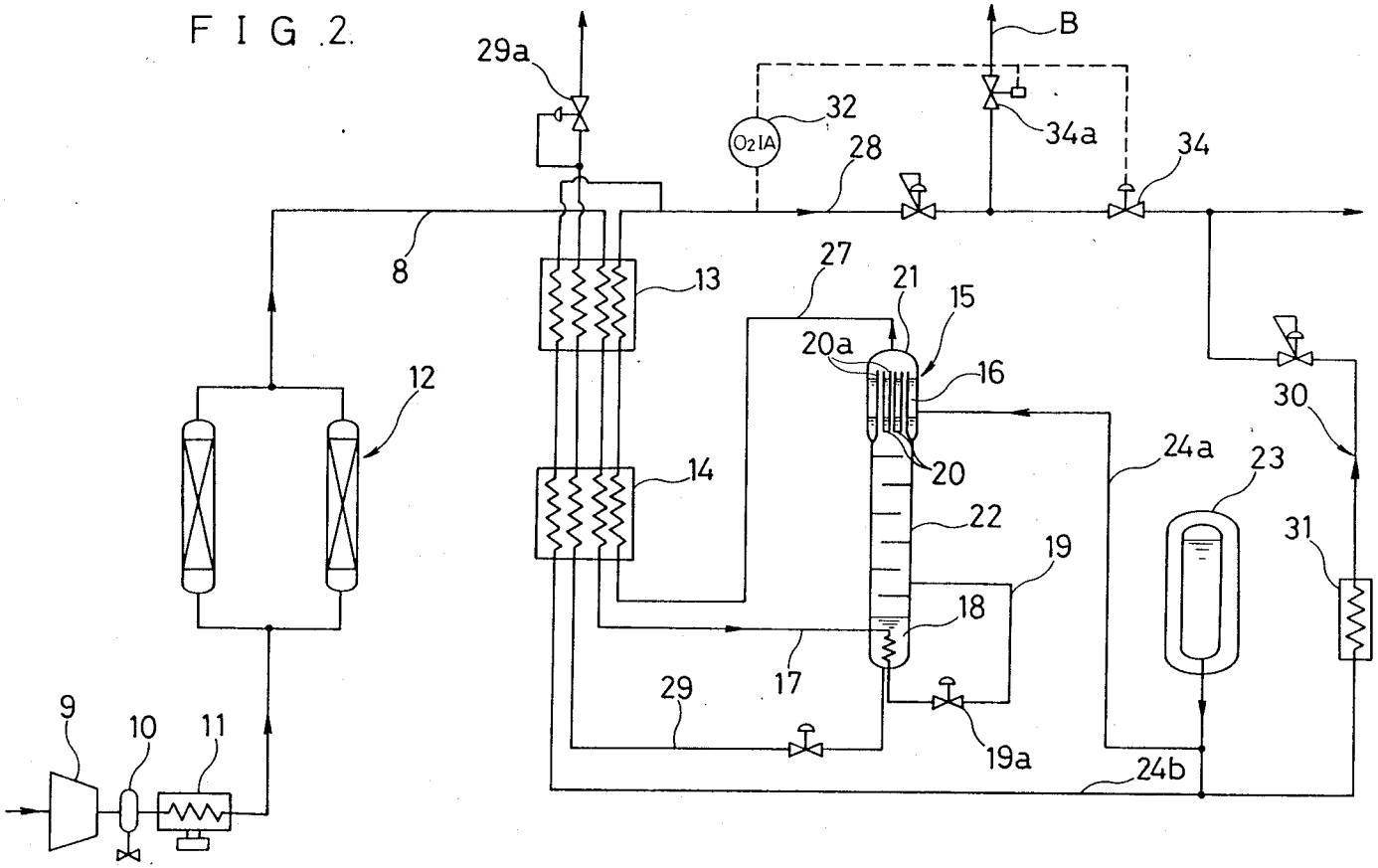
FIG. 2 and FIG. 3 each is a schematic process diagram showing a modification thereof.

In FIG. 2 is shown an embodiment wherein a nitrogen distillation column differing in type from the nitrogen distillation column in the equipment of FIG. 1 is used in place of the latter. Thus, in this distillation column 15, the partial condenser segment 21 is separated from the column segment 22 by means of partitioning plates 20 provided with a number of pipes 20a. Into this partial condenser segment 21 is fed liquid nitrogen from the liquid nitrogen storage tank 23 and this chills the compressed air supplied into the column segment 22 via the piping 19 in the pipes 20a of the partitioning plates 20, whereby oxygen in the compressed air is liquefied and falls while nitrogen alone is withdrawn in gaseous form from the top of the partial condenser segment 21. In this nitrogen distillation column 15, the internal pressure is lower as compared with the distillation column 15 in FIG. 1, so that the pressure of product nitrogen gas also becomes lower accordingly.

Figure 3:
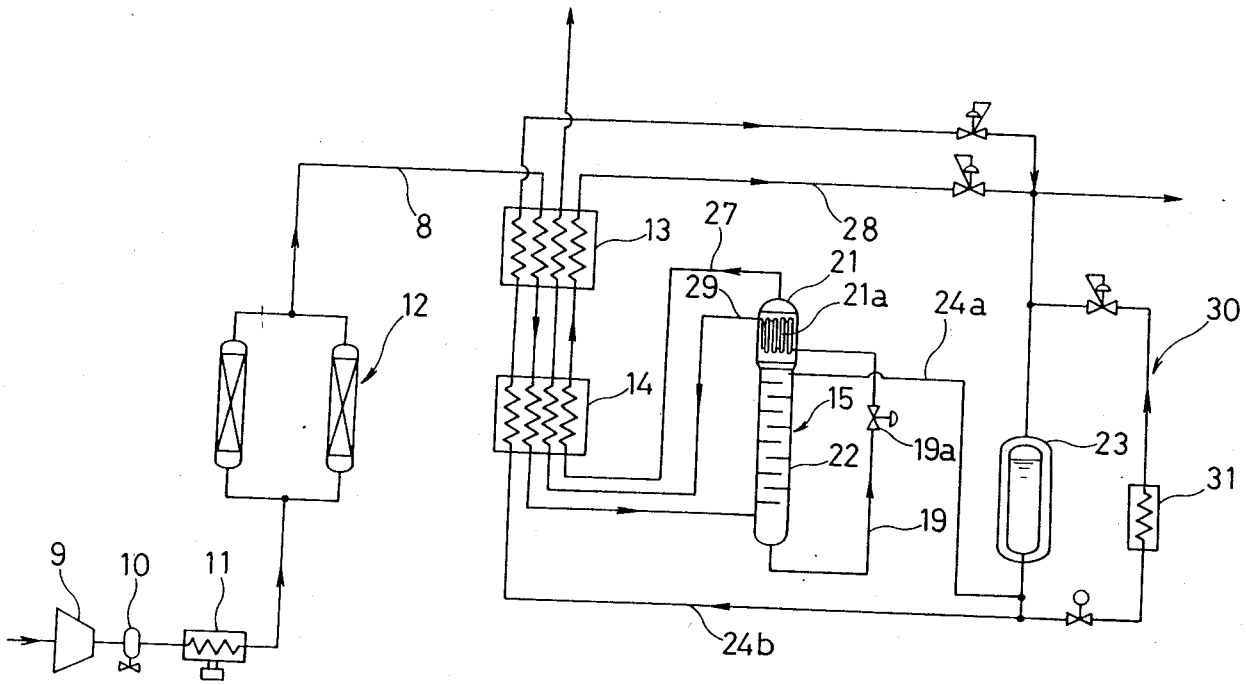

FIG. 3 shows an embodiment wherein a distillation column of a still different type is used in lieu of the distillation column shown in FIG. 1. Thus, in this distillation column 15, one column body is divided into two segments, namely the upper partial condenser segment 21 and the lower column segment 22. Within the partial condenser segment 21, there is provided a partial condenser 21*a*, to which the liquid air collecting in the bottom of the column segment 22 is supplied via the pipeline 19, while the liquid nitrogen from the liquid nitrogen storage tank 23 is supplied as reflux to the upper part of the column segment 22 via the first feeding pipeline 24*a*. Like the distillation column shown in FIG. 2, this distillation column 15 produces low-pressure product nitrogen gas.

Figure 4:
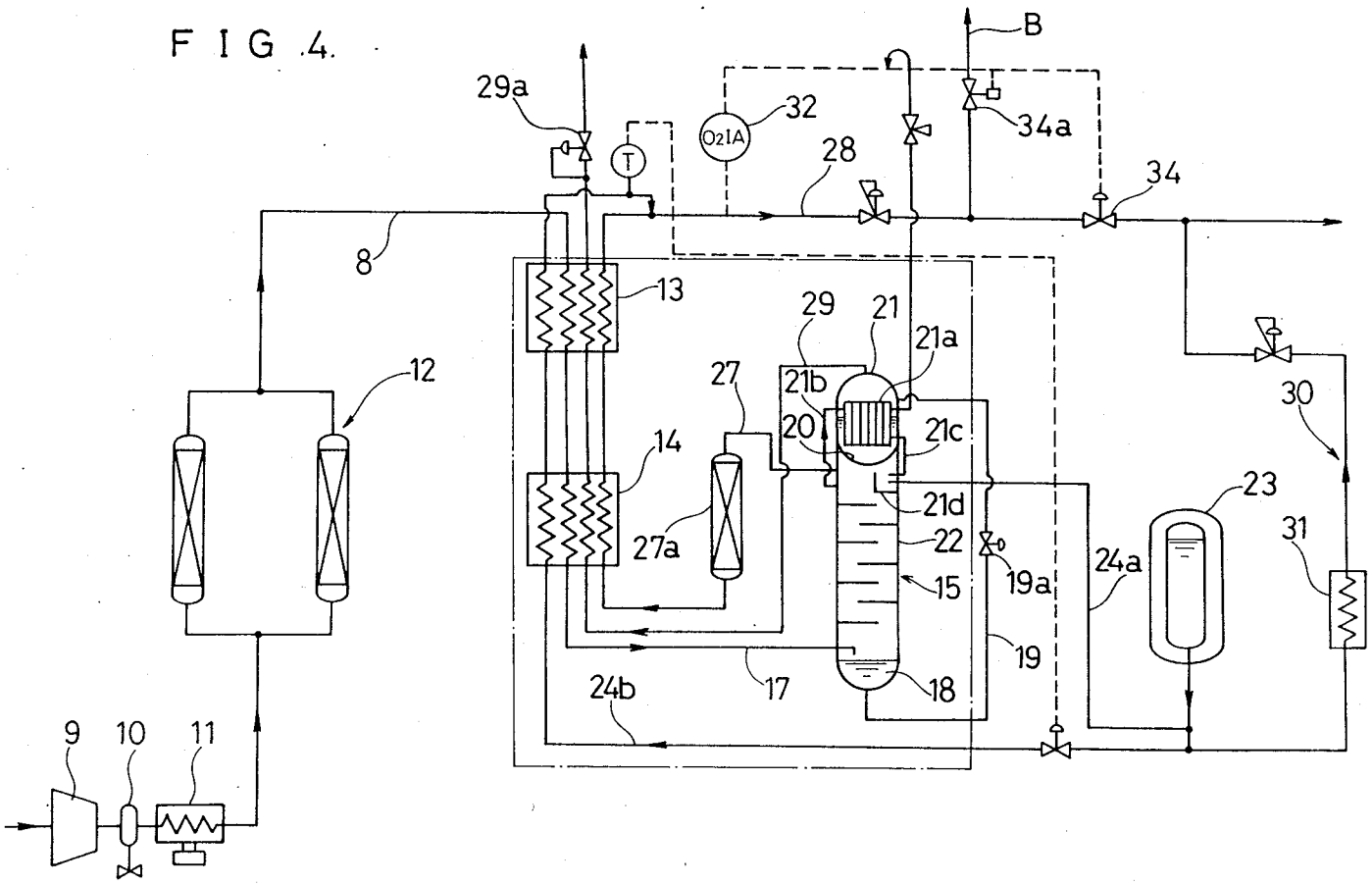
FIG. 4 is a schematic process diagram showing another embodiment.
Figure 5:
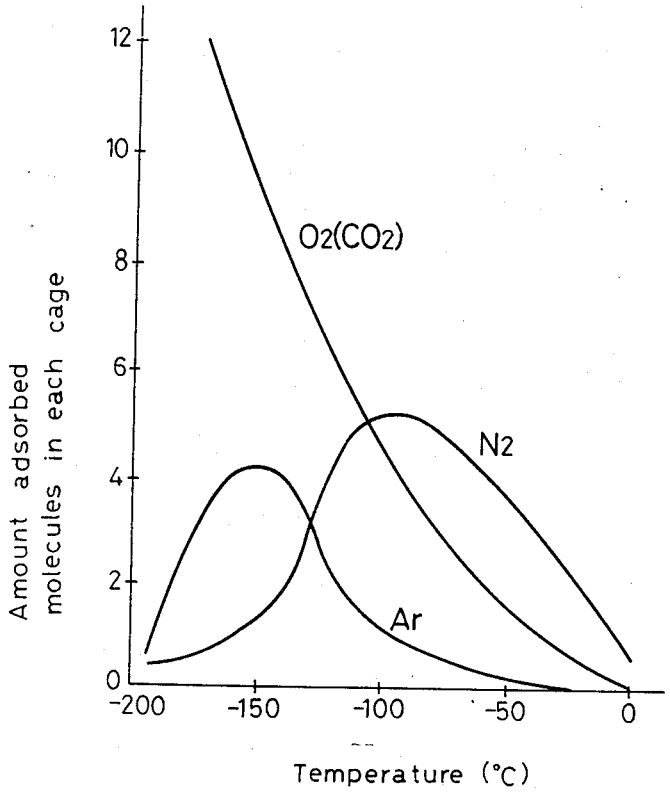
FIG. 5 shows adsorption characteristic curves for an adsorbent.

FIG. 4 shows an embodiment wherein the equipment of FIG. 1 is provided with a temperature sensor, an adsorption column and a vacuum cold housing. Thus, in this embodiment, a temperature sensor T is provided at the end, on the side of main pipeline 28, of the second feeding pipeline 24*b*. By means of the output signal of this sensor T, a valve provided at the end on the side of liquid nitrogen storage tank 23 is controlled, whereby the rate of flow of liquid nitrogen is controlled. In addition, an oxygen adsorption column 27*a* is provided in the withdrawal pipeline 27 to further increase the purity of product nitrogen gas by removing impurity oxygen, etc., in the cryogenic-temperature nitrogen gas discharged from the distillation column 15. Furthermore, the nitrogen distillation column 15, the first and second heat exchangers 13, 14 and the oxygen adsorption column 27*a* are accommodated in a vacuum cold housing (indicated in dot-dash line) for enhancement of distillation efficiency. Otherwise, this equipment is identical with the equipment illustrated in FIG. 1. The above oxygen adsorption column 27*a* is now described in further detail. This oxygen adsorption column 27*a* is packed with synthetic zeolite 3A, 4A or 5A having a pore size of 3 Å, 4 Å or 5 Å, respectively (Union Carbide's molecular sieve 3A, 4A or 5A). As shown in FIG. 5, the synthetic zeolite 3A, 4A or 5A selectively adsorbs only oxygen and carbon monoxide at cryogenic temperatures of about −150° C. Union Carbide's synthetic zeolite 13X may also be used in place of the above-mentioned synthetic zeolite 3A, 4A or 5A. In this manner, oxygen and carbon monoxide alone are selectively adsorbed in the temperature range of about −150° C., so that the cryogenic nitrogen gas becomes highly pure.

Figure 6:
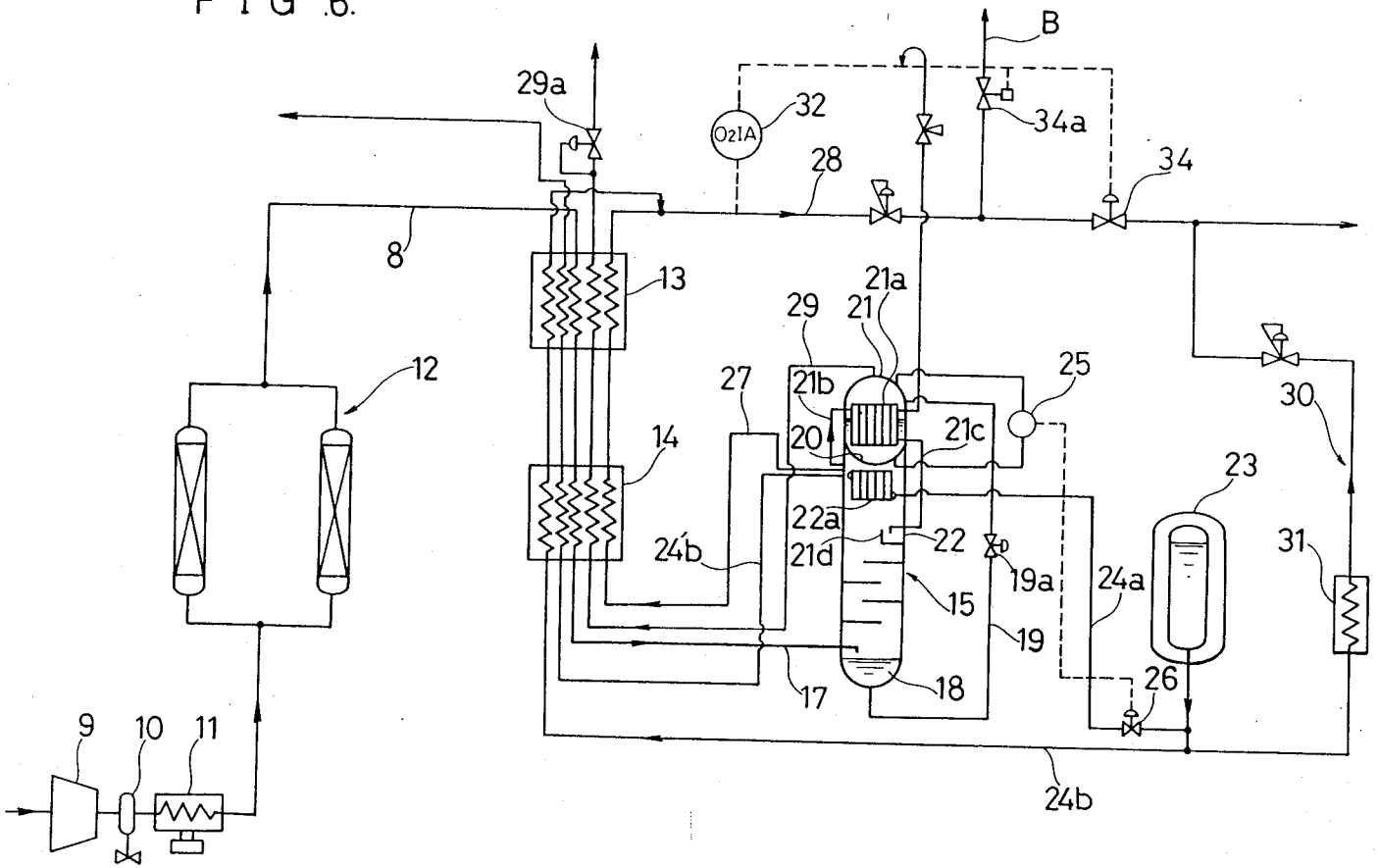
FIG. 6 is a schematic process diagram showing still another embodiment.

FIG. 6 shows an embodiment wherein a condenser is disposed in the column segment of the nitrogen distillation column in the equipment illustrated in FIG. 1, with a level gauge also disposed on the periphery. Thus, in this equipment, a condenser 22*a* is disposed in the column segment 22 of the nitrogen distillation column 15 and liquid nitrogen is fed to said condenser as a refrigerant from the liquid nitrogen storage tank 23 via the first feeding line 24*a* to chill the compressed air entering the column segment 22 at the lower part thereof and ascending in the column segment 22. High-boiling components, such as oxygen, thus liquefied are retained in the bottom of the column segment 22, while low-boiling nitrogen gas is collected in the upper part of the column segment 22. The vaporized liquid nitrogen after serving as refrigerant in the condenser 22*a* is led to a discharge pipeline 24'*b* and, after heat exchange in the second and first heat exchangers 14, 13, let out from the system. Furthermore, a level gauge 25 is provided on the periphery of the partial condenser segment 21 of the distillation column 15 and at the same time the first feeding pipeline 24*a* is equipped with a valve means 26 so that the rate of feeding of liquid nitrogen from the liquid nitrogen storage tank 23 can be controlled by controlling the valve 26 depending on the level of liquid air in the partial condenser segment 21. Otherwise, this equipment is identical with the equipment illustrated in FIG. 1.

Figure 7:
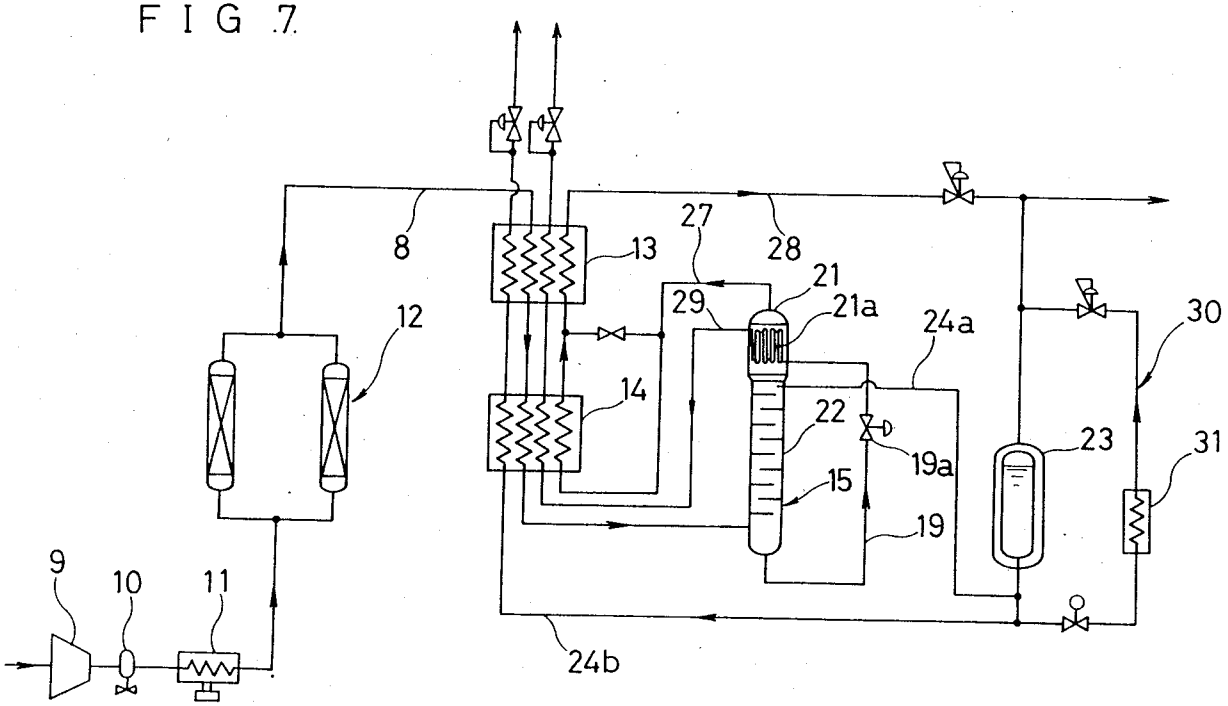
FIG. 7 is a schematic process diagram showing a modification of the embodiment shown in FIG. 3.

FIG. 7 shows a modification of the equipment shown in FIG. 3. Thus, while, in the equipment of FIG. 3, the liquid nitrogen fed to the second and first heat exchangers 14, 13 from the liquid nitrogen storage tank 23 via the second feeding pipeline 24*b* is led to the main piping 28, such nitrogen is released into the atmosphere in the equipment shown in FIG. 7.

Figure 8:
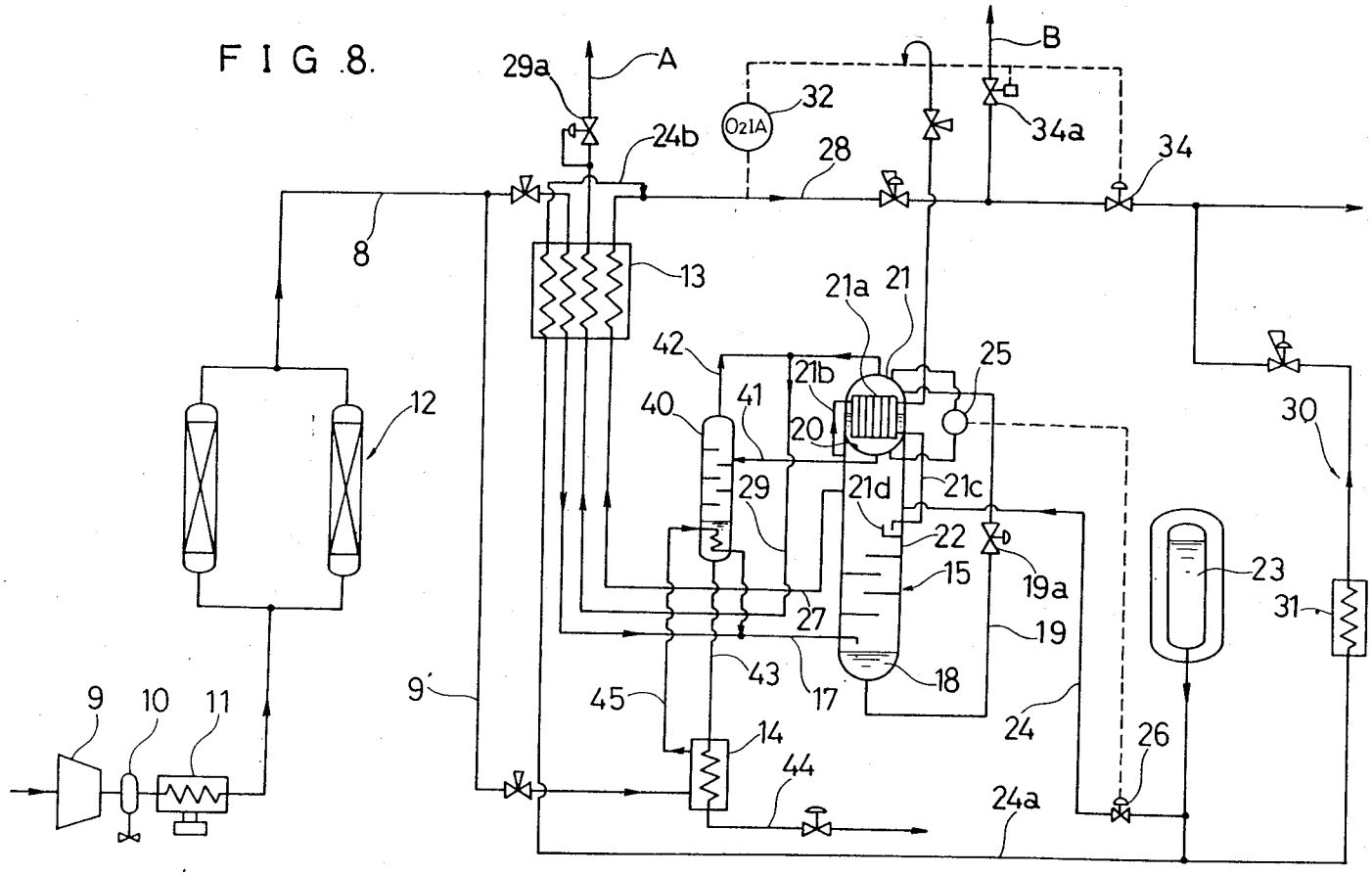
FIG. 8–12 each is a schematic process diagram showing an embodiment in which an oxygen distillation column is used additionally.

FIG. 8 shows an embodiment wherein an oxygen distillation column is added to the equipment of FIG. 1. In FIG. 8, the numeral 40 indicates an oxygen distillation column, which is connected to the bottom of the partial condenser segment 21 of the nitrogen distillation column 15 by means of a liquid air feeding pipeline 41. The liquid air introduced into the partial condenser segment 21 is then withdrawn into said oxygen distillation column taking advantage of head difference and, in said column, nitrogen is removed by evaporation, with oxygen collected in liquid state in the bottom. The numeral 42 indicates a discharge pipeline for sending the used liquid nitrogen, now in gaseous state, into the discharge pipeline 29 for discharging the vaporized liquid nitrogen in admixture with the vaporized liquid air. A withdrawal pipeline 43 for withdrawing the liquid oxygen retained in the bottom of the oxygen distillation column 40 leads said liquid oxygen to the second heat exchanger 14 and, after heat exchange with the compressed air fed through a branched pipe 9' and gasification due to temperature rise, further to a product oxygen withdrawal pipeline 44. A compressed air transfer pipeline 45 extends from the second heat exchanger 14 to the pipeline 17. On its way, said pipeline 45 passes through the oxygen distillation column 40, whereby the compressed air can heat the liquid oxygen collected in the bottom of said column to thereby vaporize the same. The vaporized oxygen comes into countercurrent contact with the liquid air falling from the pipe 41 through the column 40, so that the rectification efficiency can be improved. The numeral 25 indicates a level gauge and 26 a valve means controlled by said gauge. Otherwise, this equipment is identical with the equipment depicted in FIG. 1.

In this equipment, high-purity product oxygen gas can be obtained in an efficient manner since product oxygen gas is produced by feeding oxygen-rich liquid air 18 obtained after nitrogen gas separation to the oxygen distillation column 40 via the partial condenser segment 21 of the nitrogen distillation column 15 to thereby remove residual nitrogen from the liquid air 18 by evaporation and evaporating the thus-obtained liquid oxygen in the heat exchanger 14. In this way, this equipment can produce not only high-purity nitrogen gas but also high-purity oxygen gas with high efficiency.

Figure 9:
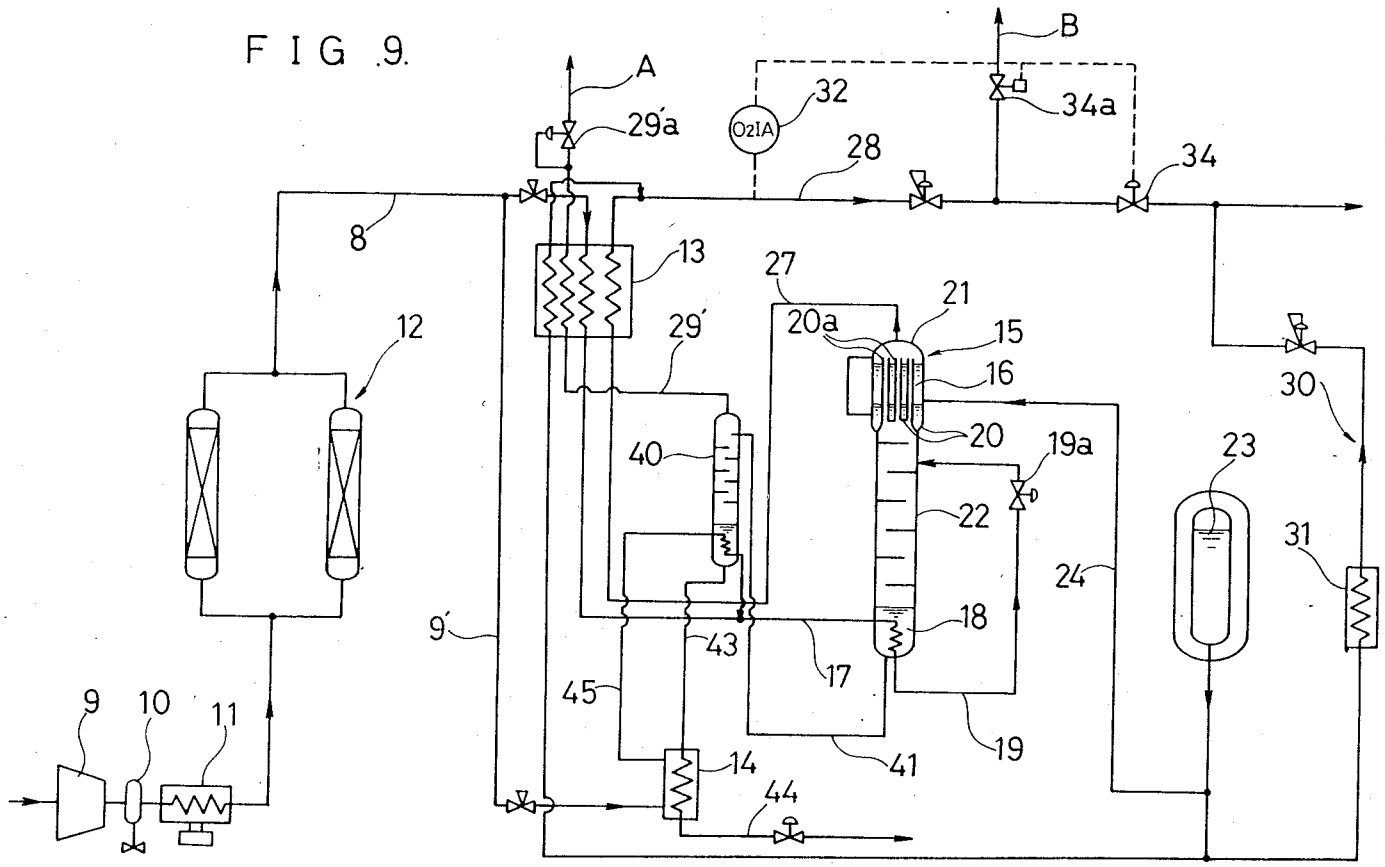

FIG. 9 shows a modification of the equipment of FIG. 8. Thus, this equipment uses another distillation column shown in FIG. 2 in place of the distillation column shown in FIG. 8. In this equipment, owing to the structure of the distillation column 15, the liquid air 18 retained in the bottom 22 of the distillation column 15 is fed to the oxygen distillation column 40 via a pipeline 41. Otherwise, this equipment is substantially identical with the equipment shown in FIG. 8.

Figure 10:
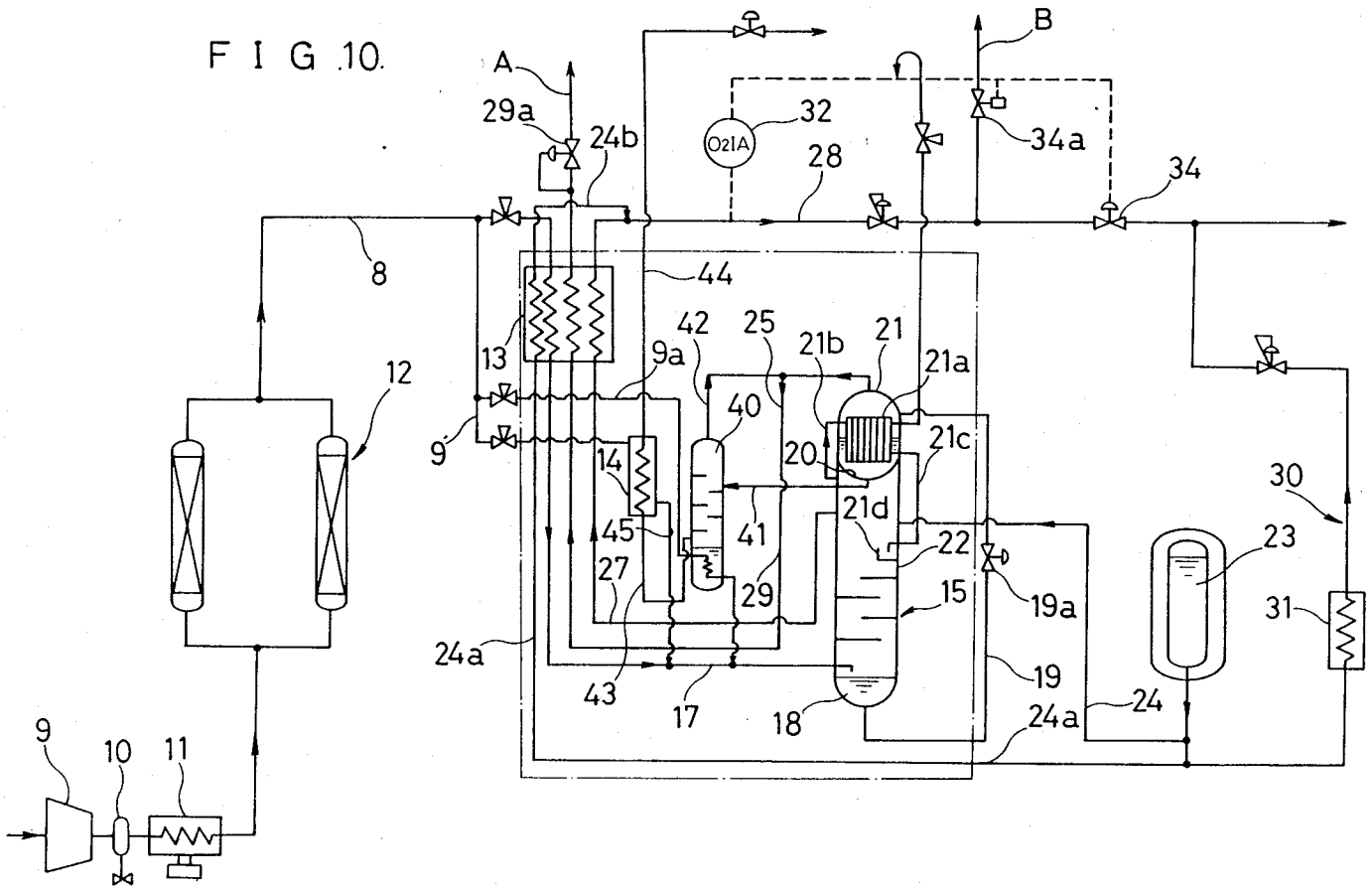

Whereas, in the embodiments shown in FIG. 8 and FIG. 9, the liquid oxygen retained in the bottom of the oxygen distillation column 40 is withdrawn, it is also possible to withdraw oxygen in vaporized state, pass the same through the second heat exchanger 14 and then withdraw it via the product oxygen withdrawal pipeline 44, as shown in FIG. 10. It is further possible to accommodate the distillation columns 15, 40 and heat exchangers 13, 14 in the vacuum cold housing indicated in dot-and-dash line, as illustrated, to thereby exclude the invasion of heat from the outside and thus increase the purification efficiency.

Figure 11:
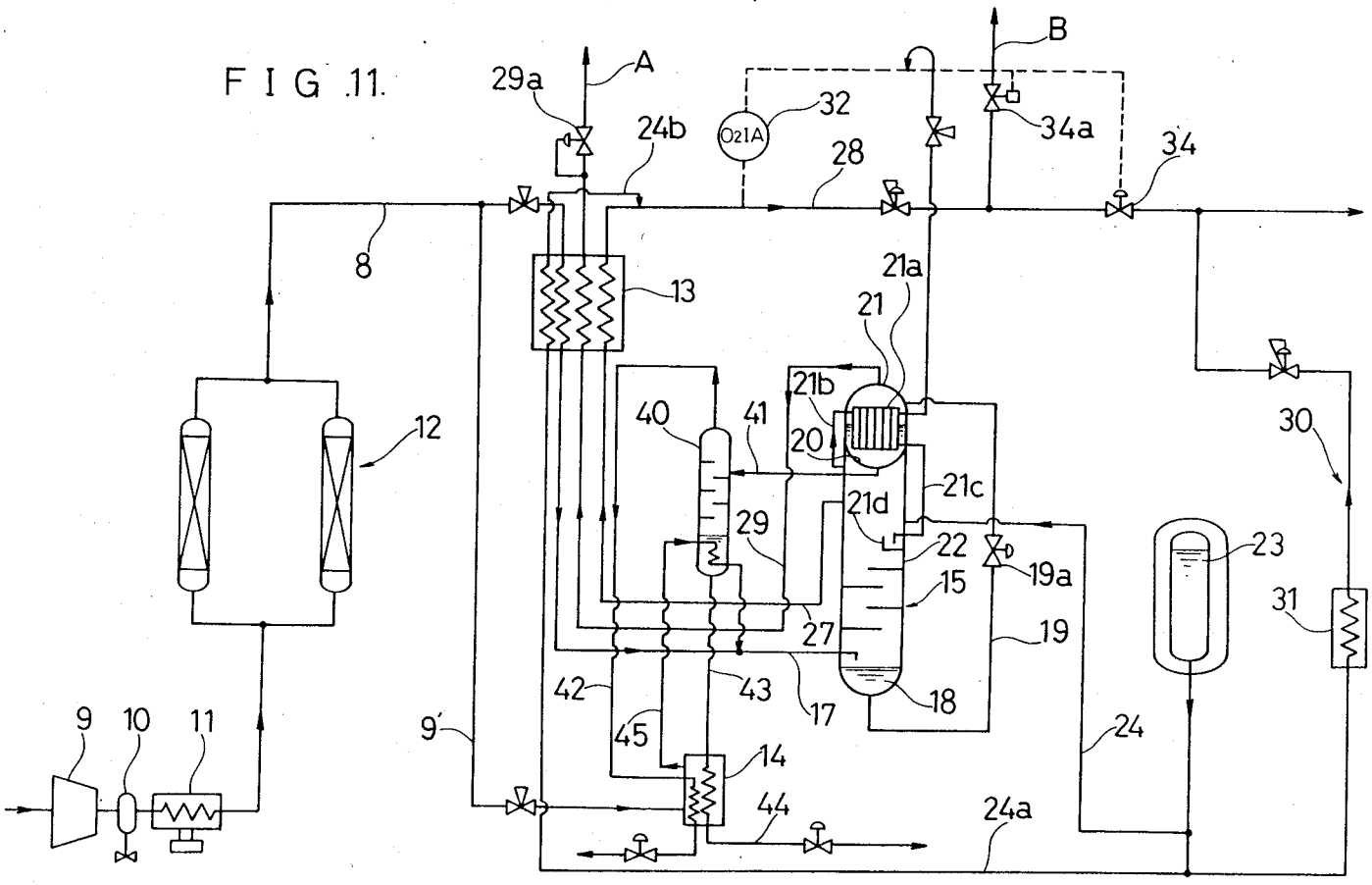

Whereas, in the equipments shown in FIG. 8 and FIG. 10, the oxygen distillation column 40 and the partial condenser segment 21 of the nitrogen distillation column 15 communicate with each other as a result of connection of the discharge pipe 42 to the vaporized liquid air discharge pipeline 29, the discharge pipeline 42 may be independent of the vaporized liquid air discharge pipeline 29 without connecting them to each other, as shown in FIG. 11. By this measure, the oxygen distillation column 40 and nitrogen distillation column 15 are put in mutually independent state, so that the production quantity of oxygen gas can be increased or decreased without being substantially influenced by the production quantity of nitrogen gas in the nitrogen distillation column 15.

Figure 12:
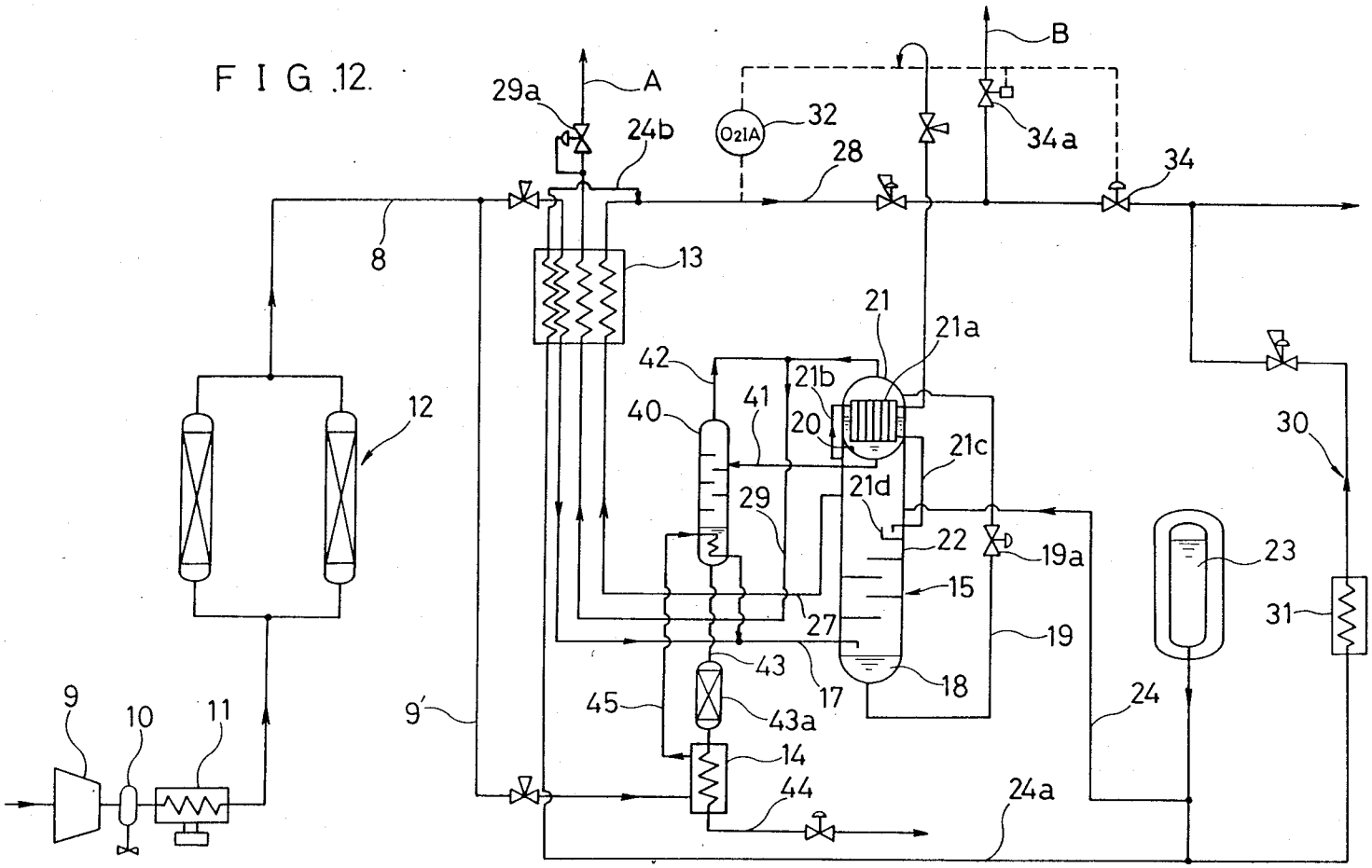

Furthermore, as illustrated in FIG. 12, it is possible to add an adsorption column 43*a* packed with a hydrocarbon adsorbent such as silica gel or alumina gel to the liquid oxygen withdrawal pipeline 43 shown in FIG. 8 so that impurity hydrocarbons contained in liquid oxygen can be removed in the mode of liquid phase adsorption.

Figure 13:
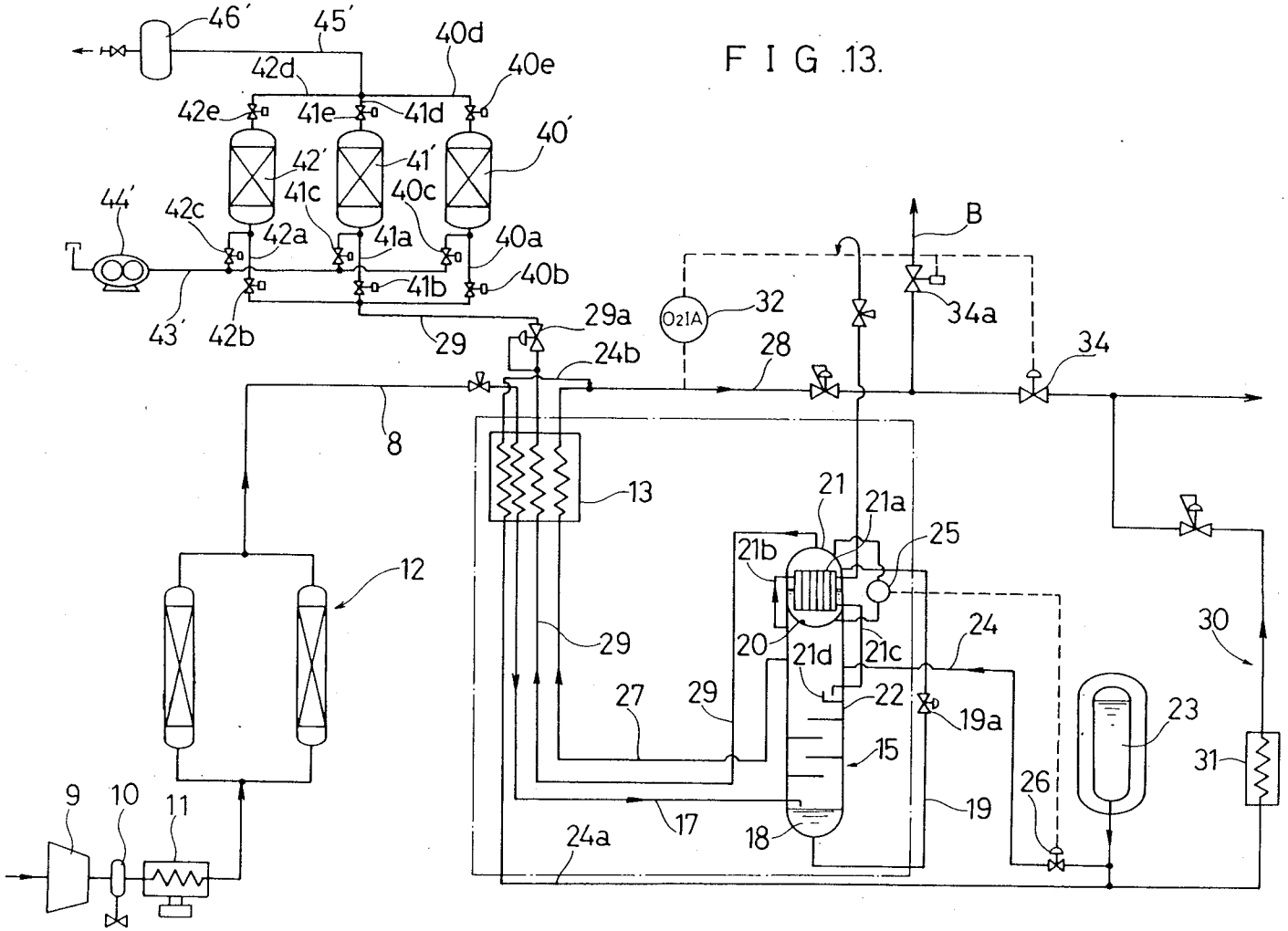
FIG. 13 and FIG. 14 each is a schematic process diagram showing an embodiment in which a nitrogen adsorption tube is used.

FIG. 13 shows an embodiment wherein the vaporized liquid air discharge pipeline 29 is provided, at the open end thereof, with a plurality of nitrogen adsorption columns for obtaining oxygen gas from the vaporized liquid air. In the figure, the numerals 40′, 41′ and 42′ each indicates an adsorption column packed with an adsorbent (synthetic zeolite: molecular sieve) capable of adsorbing $N_2$ selectively and the columns are connected, at the entrance thereof, to said discharge pipeline 29 via inlet lines 40*a*, 41*a* and 42*a* provided with valves 40*b*, 41*b* and 42*b*, respectively. A vacuum pump 44′ is connected to the entrance of each of said adsorption columns 40′, 41′ and 42′ via a suction pipeline 43′ and via suction pipelines 40*c*, 41*c* and 42*c*, respectively. Withdrawal pipelines 40*d*, 41*d* and 42*d* are connected to said adsorption columns 40′, 41′ and 42′, respectively, at the outlet thereof, and are provided with valves 40*e*, 41*e* and 42*e*, respectively. These withdrawal pipelines 40*d*, 41*d* and 42*d* are connected to a buffer tank 46′ via a product oxygen gas withdrawal pipeline 45′. While one of said adsorption columns 40′, 41′ and 42′ is used for adsorption, the remaining columns are regenerated by suction by the vacuum pump 44′. Then, one of the regenerated columns is used for adsorption while the one previously in adsorptive operation is subjected to regeneration treatment. By repeating the above procedure, adsorption can be performed continuously. In the figure, the numeral 25 indicates a level gauge and 26 a valve controlled by said gauge. Otherwise, this equipment is substantially identical with the equipment shown in FIG. 1.

In this equipment, the oxygen-rich liquid air 18 after separation of nitrogen gas is fed to the partial condenser segment 21 of the nitrogen distillation column 15 to chill the condenser 21*a* and oxygen-rich liquid air vapor formed there is not released as it is into the air but is introduced into the adsorption column 40′, (41′), (42′) to remove residual nitrogen by adsorption and thus produce product oxygen gas. Therefore, high-purity product oxygen gas can be obtained efficiently. Thus, this equipment can produce not only high-purity nitrogen gas but also high-purity oxygen gas efficiently.

Figure 14:
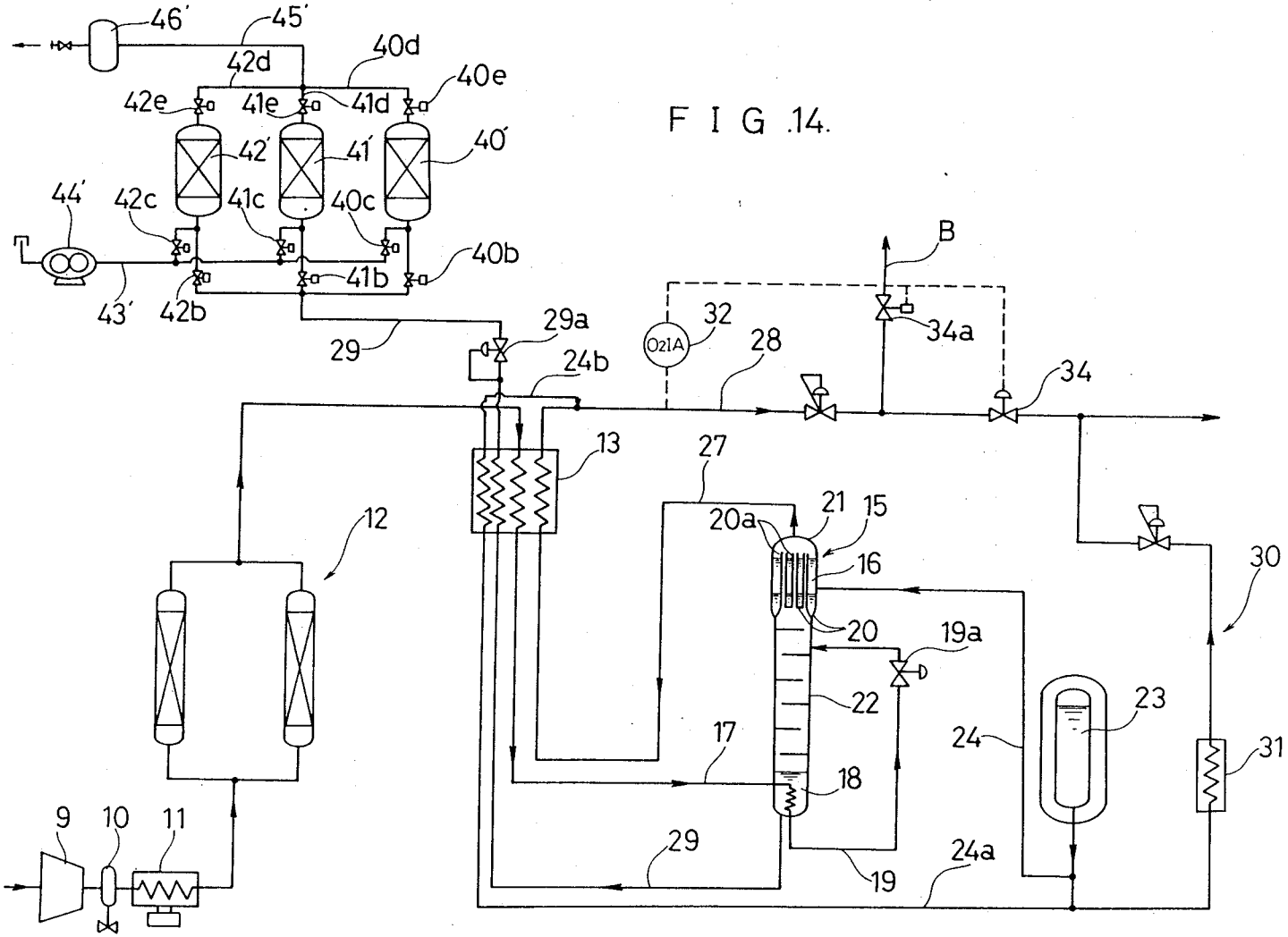

FIG. 14 shows a modification of the equipment of FIG. 13. Thus, this equipment uses the distillation column shown in FIG. 2 in place of the distillation column shown in FIG. 13. In this equipment, the structure of the distillation column 15 allows the liquid air 18 retained in the bottom of the column segment 22 of the distillation column 15 to be fed to the adsorption column 40′, (41′), (42′) via the vaporized liquid air discharge pipeline 29 after vaporization upon passing through the heat exchanger 13. Otherwise, this equipment is substantially indentical with the equipment illustrated in FIG. 13.

We claim:

1. A high-purity nitrogen gas production equipment which comprises an air compression means for compressing air from an outside source, an elimination means for removing carbon dioxide gas and water from the compressed air from said air compression means, a heat exchange means for chilling the compressed air from said elimination means to a cryogenic temperature, a nitrogen distillation column for liquefying a portion of the cryogenic compressed air from said heat exchange means and collecting it therein while retaining nitrogen only in gaseous state, a liquid nitrogen storage means for storing liquid nitrogen, a first feeding pipeline for guiding the liquid nitrogen in said liquid nitrogen storage means to said nitrogen distillation column for use as a refrigerant for liquefaction of compressed air, a second feeding pipeline for leading the liquid nitrogen in said liquid nitrogen storage means to said heat exchange means for use as a refrigerant for said heat exchange and a nitrogen gas withdrawal pipeline for withdrawing the liquid nitrogen retained within said distillation column.

2. A high-purity nitrogen gas production equipment which comprises an air compression means for compressing air from an outside source, an elimination means for removing carbon dioxide gas and water from the compressed air from said air compression means, a heat exchange means for chilling the compressed air from said elimination means to a cryogenic temperature, a nitrogen distillation column for liquefying a portion of the cryogenic compressed air from said heat exchange means and collecting it therein while retaining nitrogen only in gaseous state, a liquid nitrogen storage means for storing liquid nitrogen, a first feeding pipeline for guiding the liquid nitrogen in said liquid nitrogen storage means to said nitrogen distillation column for use as a refrigerant for liquefaction of compressed air, a second feeding pipeline for leading the liquid nitrogen in said liquid nitrogen storage means to said heat exchange means for use as a refrigerant for said heat exchange and a nitrogen gas withdrawal pipeline for withdrawing the liquid nitrogen retained within said distillation column, said equipment further comprising an adsorption means provided in the nitrogen gas withdrawal line, said adsorption means containing an adsorbent capable of selectively adsorbing oxygen and carbon monoxide at cryogenic temperatures.

3. A high-purity nitrogen gas production equipment as claimed in claim 2, wherein said adsorption means is an oxygen adsorption column packed with synthetic zeolite having a pore diameter of about 3Å, 4Å or 5Å.

4. A high-purity nitrogen gas production equipment which comprises an air compression means for compressing air from an outside source, an elimination means for removing carbon dioxide gas and water from the compressed air from said air compression means, a heat exchange means for chilling the compressed air from said elimination means to a cryogenic temperature, a nitrogen distillation column for liquefying a portion of the cryogenic compressed air from said heat exchange means and collecting it therein while retaining nitrogen only in gaseous state, a liquid nitrogen storage means for storing liquid nitrogen, a first feeding pipeline for guiding the liquid nitrogen in said liquid nitrogen storage means to said nitrogen distillation column for use as a refrigerant for liquefaction of compressed air, a second feeding pipeline for leading the liquid nitrogen in said liquid nitrogen storage means to said heat exchange means for use as a refrigerant for said heat exchange and a nitrogen gas withdrawal pipeline for withdrawing the liquid nitrogen retained within said distillation column, said equipment further comprising an oxygen distillation column for separating liquid air into nitrogen and oxygen by taking advantage of boiling point difference therebetween, a liquid air feeding pipeline for supplying the liquid air retained in said nitrogen distillation column to said oxygen distillation column, and a product oxygen withdrawal pipeline for withdrawing the oxygen separated in said oxygen distillation column.

5. A high-purity nitrogen gas production equipment which comprises an air compression means for compressing air from an outside source, an elimination means for removing carbon dioxide gas and water from the compressed air from said air compression means, a heat exchange means for chilling the compressed air from said elimination means to a cryogenic temperature, a nitrogen distillation column for liquefying a portion of the cryogenic compressed air from said heat exchange means and collecting it therein while retaining nitrogen only in gaseous state, a liquid nitrogen storage means for storing liquid nitrogen, a first feeding pipeline for guiding the liquid nitrogen in said liquid nitrogen storage means to said nitrogen distillation column for use as a refrigerant for liquefaction of compressed air, a second feeding pipeline for leading the liquid nitrogen in said liquid nitrogen storage means to said heat exchange means for use as a refrigerant for said heat exchange and a nitrogen gas withdrawal pipeline for withdrawing the liquid nitrogen retained within said distillation column, said equipment further comprising a discharge pipeline provided therein for discharging the liquefied compressed air retained in said nitrogen distillation columnn or the vapor thereof and other fluid components into the outside, an adsorption column containing an adsorbent capable of selectively adsorbing nitrogen as connected to said discharge pipeline, and a withdrawal line for withdrawing the fluid after removal of nitrogen as connected to said adsorption column.

6. A high-purity nitrogen gas production equipment as claimed in claim 5, wherein a plurality of adsorption columns are connected to the withdrawal pipeline each via a line having valve means so that any of the columns can be used upon valve switching.

* * * * *